United States Patent [19]

Kirchner et al.

[11] Patent Number: 4,735,360

[45] Date of Patent: Apr. 5, 1988

[54] METHOD AND APPARATUS FOR ELECTROSTATIC SPRAY POWDER COATING

[75] Inventors: Wolfgang Kirchner, Leutenbach; Otto Gebhardt, deceased, late of Fellbach, both of Fed. Rep. of Germany, by Marianne E. Gebhardt, Annette B. Gebhardt, Hans-Joachim Gebhardt, Carl-Christof Gebhardt, heirs

[73] Assignee: Kopperschmidt-Mueller GmbH & Co. KG, Fed. Rep. of Germany

[21] Appl. No.: 681,851

[22] PCT Filed: Apr. 6, 1984

[86] PCT No.: PCT/EP84/00099

§ 371 Date: Dec. 4, 1984

§ 102(e) Date: Dec. 4, 1984

[87] PCT Pub. No.: WO84/03846

PCT Pub. Date: Oct. 11, 1984

[30] Foreign Application Priority Data

Apr. 7, 1983 [DE] Fed. Rep. of Germany ..... 3312509
Apr. 4, 1984 [DE] Fed. Rep. of Germany ..... 3412694

[51] Int. Cl.[4] ..... B05B 5/02

[52] U.S. Cl. ..... 239/3; 239/705; 239/296; 239/403

[58] Field of Search ..... 239/3, 690, 696–698, 239/704–708, 431, 296, 290, 400, 403, 406

[56] References Cited

U.S. PATENT DOCUMENTS

| | | | |
|---|---|---|---|
| 3,049,092 | 8/1962 | Sedlacsik et al. | 239/698 X |
| 3,606,972 | 9/1971 | Ferrant | 239/706 X |
| 3,759,151 | 8/1972 | Fabre | 239/3 X |
| 3,819,115 | 6/1974 | Soderman | 239/698 |
| 4,235,381 | 11/1980 | Vila | 239/707 X |
| 4,324,361 | 4/1982 | Moos et al. | 239/706 X |
| 4,341,347 | 7/1982 | De Vittorio | 239/706 X |
| 4,380,320 | 4/1983 | Hollstein et al. | 239/704 X |

FOREIGN PATENT DOCUMENTS

| | | |
|---|---|---|
| 1284883 | 12/1968 | Fed. Rep. of Germany . |
| 2541927 | 4/1976 | Fed. Rep. of Germany . |

*Primary Examiner*—Andres Kashnikow
*Attorney, Agent, or Firm*—Harness, Dickey & Pierce

[57] ABSTRACT

The invention relates to a method and apparatus for electrostatic spraying of powder particles on a surface to be coated. The carrying gas powder mixture axially discharged from a nozzle is expanded by a radially discharged control air stream to thereby form the desired spray mist. The electrostatic charging of the powder is achieved by an ionized gas stream which is fed into the carrying gas powder mixture separately from the control air stream. Some of the advantages achieved by the invention are an improved spray pattern and a more uniform coating.

13 Claims, 1 Drawing Sheet

METHOD AND APPARATUS FOR ELECTROSTATIC SPRAY POWDER COATING

The present invention relates to a method for electrostatic powder coating by spraying powder particles entrained in a carrying gas stream upon a surface to be coated, using a spray device, in particular a spray gun, in which method the powder is dispersed by carrying gas and the carrying gas powder mixture discharged from an outlet nozzle in an axial direction is expanded by control air introduced into the carrying gas powder mixture through a radial gap in a substantially radial direction, and the carrying gas powder mixture is ionized, and the invention furthermore relates to an apparatus for performing such method.

In a known spray apparatus as shown in German Patent Specification No. 23 12 363 the carrying gas powder mixture is passed by a deflection device ejecting an air stream in a radial direction. By regulating the radial air stream various patterns of a powder mist may be obtained. For ionizing the powder an electrode disposed within a tube in the path of the carrying gas powder mixture is provided.

From German Patent Specification No. 24 46 022 it has become known to branch off a partial air stream from a dispersing air stream and to ionize said partial air stream when passing by at least one needle electrode and to direct said partial air stream towards the projecting spray jet. Said needle electrode freely projects outwardly and faces the surface to be coated.

From U.S. Pat. No. 3,049,092 a spray apparatus for wet paint has become known, in which the dispersing air is radially deflected from a baffle and the ejected air stream is used to disperse the wet paint axially projecting from an annular gap. The atomizing air stream may be regulated only within restricted limits with a view to complete dispersion of the paint. Ionization is achieved by corona at the area of the peripheral edge of the baffle, a high voltage being applied to the spray head.

A primary object to be solved by the present invention is to provide a method and an apparatus for electrostatic spray powder coating allowing to achieve improved spray patterns and to ionize the powder particles such as to provide for a more uniform coating of the workpiece surface.

The present invention as well as further developments of the invention are defined in the claims.

According to the present invention the ionized gas stream is discharged separately from the control air stream serving to expand the carrying gas powder mixture. Since the control air stream is controllable both with respect to pressure and mass, a desired pattern of the spray mist may be obtained in a simple and advantageous manner. Ionization of the carrying gas powder mixture is obtained by the ionized gas stream fed into the carrying gas powder mixture downstream of the control air stream. So the ionized gas stream is fed into the carrying gas powder mixture in a zone of reduced flow velocity, i.e. downstream of the control air stream for expanding and retarding, such that the time period for ionization of the powder particles is increased.

By the positioning of the electrode a direct field influence on the surface to be coated is avoided. The indirect influence which the electrical field originating from the electrode has upon the surface to be coated is decreased. In particular a field line concentration at edges and projections of the surface to be coated is avoided such that a more uniform coating is obtained. Furthermore the ionized gas stream is independent of the control air stream and accordingly is adjustable in an extremely efficient manner.

According to patent claim 2 the carrying gas powder mixture may be directly charged additional to the electrostatic charging by the ionized gas stream. The electrostatic charging of the powder particles may be varied and effectively adjusted by controlling the direct charging and by controlling the ionized gas stream. Controlling of the direct charging may be obtained either by varying the voltage applied to the electrode or by weakening the electric field. Charging of the ionized gas stream is preferably obtained by controlling the gas volume.

The invention is explained in more detail with respect to the drawings in which

Figure 1:
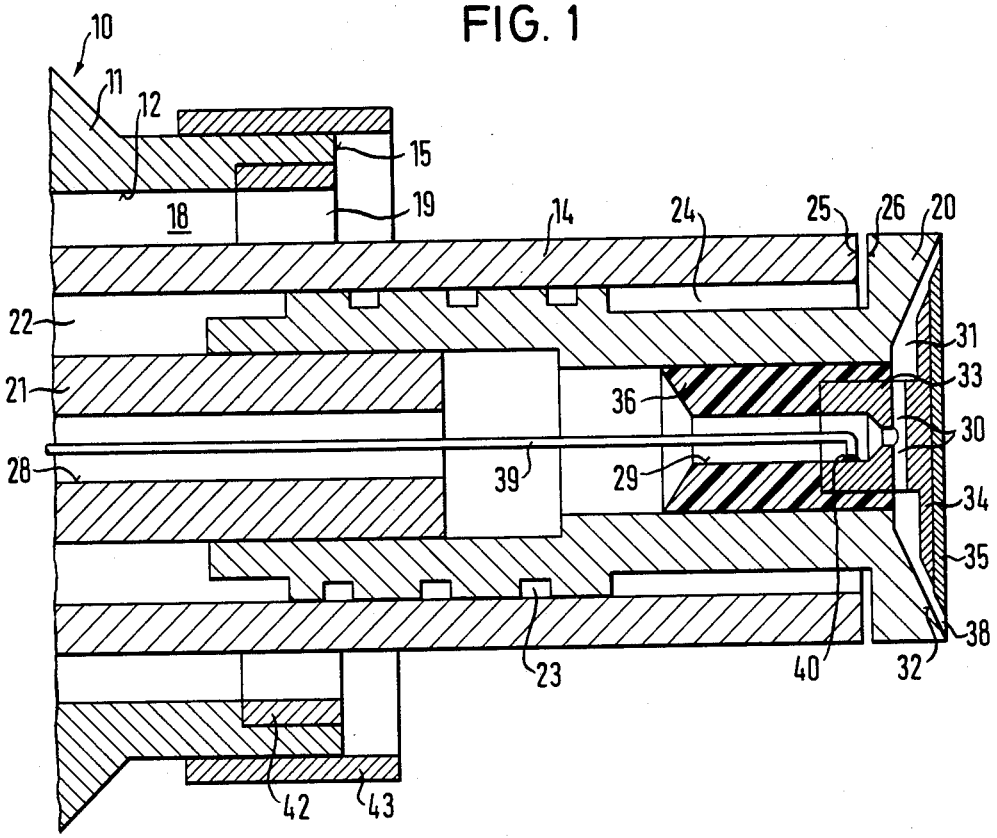
FIG. 1 is a cross section of the front part of a spray apparatus.

In FIG. 1, a housing 11 of a spray apparatus 10 includes a longitudinal bore 12 receiving a tube 14 which projects beyond the front face 15 of housing 11 and is made of electrically insulating material.

A carrying gas powder mixture is introduced in an annular passage 18 between housing bore 12 and tube 14 at the rearward side of the spray apparatus (not shown) in a conventional manner and leaves passage 18 at an outlet nozzle 19 as a substantially axial stream.

At the front end of tube 14 there is provided an insert member 20 extending around one end of a further tube 21 disposed within tube 14. A gas stream is fed through an annular gap 22 between tubes 14 and 21, a swirling motion being applied to said gas stream by one or a plurality of helical grooves 23 at the outer periphery of the insert member 20, said gas stream thereafter flowing through an annular passage 24 between insert member 20 and tube 14. The gas stream leaves the annular passage 24 in a radial direction through a radial gap between the front face 25 of tube 14 and a radial shoulder 26 on insert member 20. The outer diameter of insert member 20 is aligned with the outer diameter of tube 14, with the insert member 20 forming a forward extension of tube 14 within the cross section as determined by tube 14.

The control air discharged from gap 25,26 serves to retard and expand the carrying gas powder mixture discharged from outlet nozzle 19. By suited regulation of the control air the pattern of the powder mist may be precisely adjusted. For controlling the control air a valve (not shown) is provided in the feed line of the control air.

A further gas stream flows through a longitudinal bore 28 of the inner tube 21 and through a blind bore 29 and a plurality of radial bores 30 in a recess 31 in one end face of insert member 20. End face 32 has the shape of a hollow cone. Within recess 31 formed thereby there are disposed a disc shaped electrode 34 and an insulating disc 35. Electrode 34 is provided with a socket 33 fixed in insert member 20 by means of an insulating sleeve 36. Preferably, socket 33 has outer threads (not shown) in engagement with inner threads (not shown) of sleeve 36 such that the width of annular gap 38 between end face 32 and the outer peripheral edges of electrode 34 and insulating disc 35 is precisely adjustable. A high voltage feed line 39 extends through longitudinal bore 28 of inner tube 21 in a forward direction and is connected to socket 33 at 40 within bore 29.

Electrode 34 is a so called semiconductor electrode, i.e. is of a relatively high electric resistance. The electric resistance of the semiconductor electrode is high enough so as to prevent any impulse discharge at the outer peripheral edge of the disc-shaped electrode so that no short circuit is possible.

The diameter of insulating disc 35 is greater than that of electrode 34, however smaller than that of insert member 20 at its forward area. This results in the field strength and the field line concentration of the field originating from the outer peripheral edge of electrode 34 being substantially decreased to thereby avoid an undesired field effect between the electrode and edges or projections of the workpiece surface to be coated.

The gas stream projecting from radial openings 30 is ionized by the high electric potential of the electrode when passing through annular gap 38 between electrode 34 and end face 32, and reaches the carrying gas powder mixture at an area of practically minimum flow velocity, i.e. after the carrying gas powder mixture has been retarded by the control air, with the carrying gas powder mixture having been deflected by the control air discharged from gap 25,26. The powder particles dispersed in the carrying gas stream are uniformly mixed with the highly ionized gas stream, the powder particles being electrostatically charged, which is achieved mainly by settling down of gas ions. Charging of the powder particles is enhanced by the ions settling down from the gas stream and also due to the powder particles lingering at an area of high ion concentration. According to the present invention this allows to obtain a highly uniform spray pattern resulting in a uniform coating of the surface of an earthed workpiece. Furthermore electrode 34 is disposed such that it does not contact the powder stream.

The amount of charging of the powder particles may be optimized by controlling the gas stream via a valve (not shown). According to the present invention the pattern and degree of charging of the spray mist may be optimized by controlling the control air and the ionized gas stream.

At end face 15 of housing 11 an annular electrode 42 of semiconductor material may be incorporated, to which electrode a high voltage may be applied in a manner not shown. Annular electrode 42 faces passage 18 and serves for additional electric charging of the carrying gas powder mixture. Furthermore on housing 11 a sleeve 43 of insulating material is axially displaceable, whereby the effect exerted by the electric field generated by electrode 42 on the workpiece surface to be coated may be increased or decreased. Furthermore the voltage applied to electrode 42 may be varied. In this manner the deposition effect of the field forces produced by the ionized gas stream on the one hand and by the additional electrode 42 on the other hand may be matched to each other.

Figure 2:
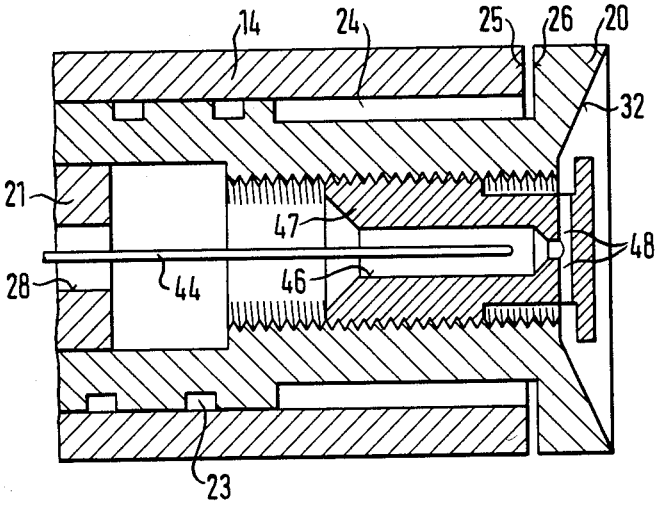
FIG. 2 is a cross section of the front part of another embodiment of a spray apparatus.

FIG. 2 discloses a modified embodiment in which the carrying gas powder mixture flowing axially along the outer surface of tube 14 may also be expanded by the control air discharged from the gap between surfaces 25 and 26. A gas stream flows through a longitudinal bore 28 of inner tube 21 into a bore 46 within a nozzle member 47 and is discharged through radial bores 48 with uniform distribution. The gas stream is deflected radially outwards by a conically shaped hollow end face 32 of insert member 20 and is directed upon the carrying gas powder mixture. Ionizing this gas stream is achieved by a needle electrode 44 extending into bore 46 of nozzle member 47.

We claim:

1. A method for electrostatic powder coating by spraying powder particles entrained in a carrying gas stream upon a surface to be coated, said method comprising dispensing an ionized powder by a carrying gas in an axial direction, introducing a control air into the carrying gas powder mixture in a substantially radial direction for retarding the axial velocity of the carrying gas powder mixture, characterized in that a gas stream is fed through a passage separate from those of the carrying gas powder mixture and from the control air and is ionized before being discharged, said gas stream being introduced in a substantial radial direction in an area of reduced flow velocity of the carrying gas powder mixture.

2. The method of claim 1, characterized in that the carrying gas powder mixture is electrostatically charged before the ionized gas stream is fed thereinto, the electrostatic charge and the ionization of the carrying gas powder mixture being matched to each other by controlling the ionized gas stream.

3. An apparatus for electrostatic spray powder coating comprising a tube extending forwards beyond an outlet nozzle for discharging a carrying gas powder mixture, said tube including an annular passage for feeding control air, a radial gap between the forward end of the tube and an insert member closing said end of the tube, said radial gap communicating with said annular passage for expanding the carrying gas powder mixture discharged from said outlet nozzle through the action of said control air, and in electrode for ionizing the carrying gas powder mixture, characterized in means for introducing an ionized separately fed gas stream into the gas powder mixture downstream of said radial gap.

4. The apparatus of claim 3, characterized in that the separately fed gas stream is ionized by a needle electrode disposed in a passage concentric with the annular passage for the control air.

5. The apparatus of claim 3, characterized in that the separately fed gas stream is ionized by a disc-shaped electrode.

6. The apparatus of claim 5 , characterized in that the disc shape electrode is disposed at the end face of the insert member and has a diameter that is smaller than the diameter of said end face, the side of said disc-shaped electrode facing the article being coated being shielded by an insulating disc, and further including a plurality of openings for feeding the separately fed gas stream extends from a radial longitudinal bore within said insert member to a radially extending annular gap provided between said insert member and said disc-shaped electrode, said separately fed gas stream being fed into the carrying gas powder mixture in a substantially radial direction in the area where the gas stream is expanded by the control air.

7. The apparatus according to claim 3, characterized in that a recess is formed by a hollow cone-shaped end face of the insert member.

8. The apparatus of claim 3, characterized in that the tube and a portion of the insert member extending beyond the end of said tube are of the same cross section.

9. The apparatus of claim 3, characterized in that said insert member is provided with helical grooves in the area of the annular passage for imparting a swirl to the control air.

10. The apparatus of claim 3, characterized in that the electrode comprises an annular electrode.

11. The apparatus of claim 10, characterized in that said annular electrode is disposed at the inner periphery of the open end of a housing received within the tube and in that a sleeve of insulating material is displaceably mounted on the outer periphery of the outlet nozzle.

12. The apparatus of claim 6, characterized in that the electrode and the insulating disc are disposed within the annular recess of said end face of said insert member.

13. The apparatus of claim 3 wherein the ionized separately fed gas stream is introduced into the gas powder mixture in a generally radial direction.

* * * * *